United States Patent [19]

Berkhin et al.

[11] 4,296,867

[45] Oct. 27, 1981

[54] DEVICE FOR LOCKING SLEWING PORTION OF CARGO CRANE

[76] Inventors: Iosif M. Berkhin, prospekt Gagarina, 17, kv. 35; Robert A. Gudze, prospekt Gagarina, 17, kv. 11; Vasily I. Kekalo, ulitsa Letchikov, 33, kv. 88, all of Sevastopol; Nikolai N. Panasenko, Volgodonsk, ulitsa Morskaya, 118, kv. 46, Rostovskaya oblast; Viktor I. Podbeltsev, ulitsa B. Morskaya, 38, kv. 4, Sevastopol; Zinaida D. Tsypina, ulitsa Volodarskogo, 5, kv. 5, Sevastopol; Vladislav N. Mukhin, ulitsa B. Morskaya, 52/2, kv. 36, Sevastopol, all of U.S.S.R.

[21] Appl. No.: 75,108

[22] Filed: Sep. 16, 1979

[51] Int. Cl.[3] ..... B66C 23/62

[52] U.S. Cl. ..... 212/229; 188/60

[58] Field of Search ..... 212/229; 188/31, 60

[56] References Cited

U.S. PATENT DOCUMENTS

| | | | |
|---|---|---|---|
| 1,808,898 | 6/1931 | Kerr | 212/229 |
| 3,877,549 | 4/1975 | Clark | 188/60 X |

*Primary Examiner*—Robert G. Sheridan

*Attorney, Agent, or Firm*—Fleit & Jacobson

[57] ABSTRACT

A device for locking a slewing portion of a cargo crane relative to a stationary portion thereof, comprising stops arranged respectively on these portions of the crane, and appliances for holding these stops in contact with each other at locking. The stops are rigidly secured on appropriate portions of the crane so that in the process of locking these stops are arranged at a certain distance from each other, and each appliance for holding these stops in contact is a drive-operated wedge to be placed between these stops in the process of locking.

7 Claims, 5 Drawing Figures

DEVICE FOR LOCKING SLEWING PORTION OF CARGO CRANE

The present invention relates to materials handling machine-building industry and more particularly to devices for locking a slewing portion of a cargo crane relative to a stationary portion thereof.

A locking device made according to the present invention is especially well suited for use on sea-going floating cranes and on ship cranes.

The proposed device can possibly be used for locking slewing portions of excavators, gantry, tower and other slewing cranes.

Known in the art are locking devices comprising a pedestal stop made with a conical head and installed on a stationary portion, viz. a pontoon deck, two other stops being installed on a crane slewing portion and adapted to be rotated relative thereto. These stops have a shaped (cylindrical) surface coming in contact with the conical head of the pedestal in the process of crane locking.

For bringing the stops in contact with the pedestal and holding them in this position, the stops are coupled by way of rods with a translating component of a nut-leadscrew kinematic pair.

In these devices, excessive stresses are set up between the pedestal cone and cylindrical surfaces of the stops owing to a point contact. During a continuous cyclic application of loads (which occurs during sea passages of floating cranes) the contacting surfaces get mutilated and large clearances are formed, which gives rise to application of shock loads resulting in breakage of the device units.

In addition, the prior art device comprises a complex articulated linkage of the stops, in which loads are transferred through the rods to the leadscrews transversely, thus causing a substantial deflection of the leadscrews and jamming of the nuts sliding therealong which in its turn renders the device unreliable in operation.

It is an object of the present invention to provide such a device for locking a slewing portion of a cargo crane relative to a stationary portion thereof, wherein stops and an appliance for holding the stops in contact are comparatively simple in construction ensuring a reliable operation of the device practically under any loads.

It is another object of the present invention to increase the service life of a device.

It is still another object of the present invention to cut down expenses for manufacture of a device.

With these and other objects of the invention in view there is provided a device for locking a slewing portion of a cargo crane relative to a stationary portion thereof, comprising stops arranged respectively on these portions of the crane, and appliances for holding the stops in contact with each other at locking, according to the invention the stops are rigidly secured on appropriate portions of the crane so that these stops are disposed at a certain distance from each other in the process of locking, and each appliance for holding these stops in contact is a drive-operated wedge to be placed between the adjacent stops in the process of locking.

The provision of wedges made it possible to obviate the need for a precise positioning of the crane slewing portion at its locking.

It is preferable on at least one of the stops abutting on each wedge to pivotally secure a part having a flat surface being in contact with the wedge surface.

The installation of a pivotally secured part provides a comparatively larger area of contact between the wedges and stops due to a self-alignment of this part with the slewing portion of a crane being in any position relative to the stationary portion in the process of locking.

It is also preferred to make the wedge with an angle of inclination not exceeding 6°.

Such an angle of inclination is selected for a wedge made from steel which ensures self-braking of the wedge, with the result that the transfer of loads to the wedge drive is obviated.

It is preferable to make the wedge drive in the form of a nut-leadscrew kinematic pair to be mounted on a stop secured to the slewing portion of a crane.

Such a preferred embodiment of the wedge drive is most simple in construction and reliable in operation.

Alternatively the stops secured on the slewing portion of a crane may be made U-shaped to pass in the process of crane slewing a stop secured on the stationary portion.

Such a shape of the stop ensures the most suitable system for the transfer of loads (a beam resting on two supports).

The locking device made according to the present invention, though being comparatively simple in construction, ensures a reliable locking of the slewing portion of a cargo crane practically under any loads set up during sea passages of a floating crane.

The invention will now be described in detail with reference to the accompanying drawings illustrating a specific embodiment thereof, in which.

Figure 1:
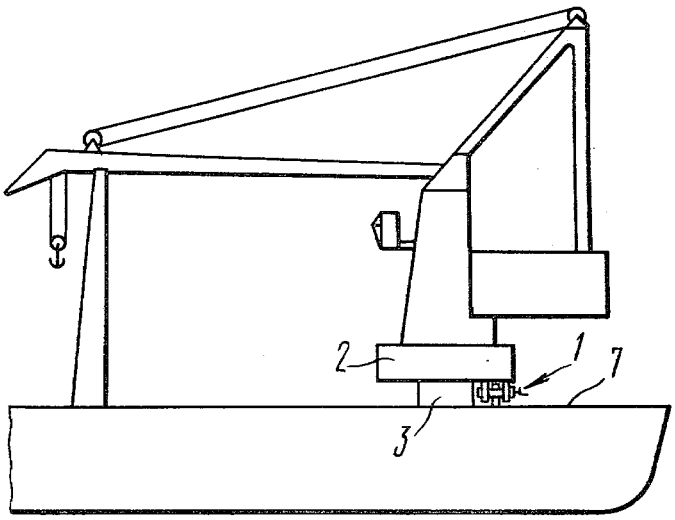
FIG. 1 is a general view of a crane in a locked position.
Figure 2:
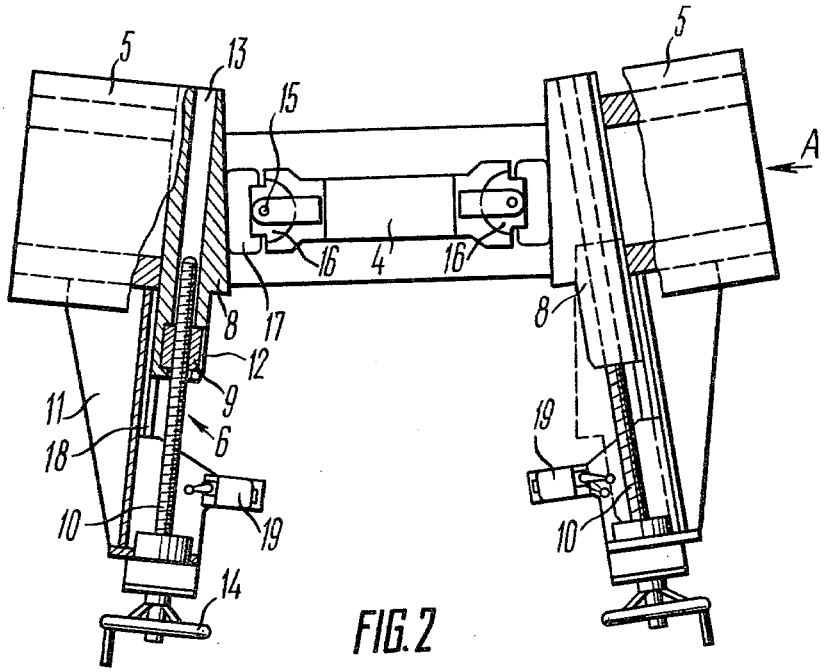
FIG. 2 is a partially cut-away top view of a locking device, according to the invention, shown in the process of locking.

A device 1 (FIG. 1) for locking a slewing portion 2 of a crane relative to a stationary portion 3 thereof comprises stops 4 (FIG. 2) and 5, and appliances 6 for holding these stops in contact with each other in the process of locking. The stop 4 is rigidly secured on the crane stationary portion 3 which, in its turn, is rigidly secured on a floating base 7 (FIG. 1).

The stops 5 are rigidly secured on the crane slewing portion 2 and symmetrically arranged relative to the stop 4 in a position corresponding to the locked condition of the crane slewing portion 2.

In the process of locking, each stop 5 is disposed at a certain distance from the stop 4 sufficient to accommodate the appliance 6 for holding these stops in contact. Each appliance 6 comprises a drive-operated wedge 8 made from steel and having an angle of inclination not exceeding 6°. Such an angle of inclination ensures a self-braking of the wedge.

If the wedge is made from other materials, the angle of inclination should be selected so as to ensure the self-braking.

A drive of the wedge 8 is presented by a nut 9-leadscrew 10 kinematic pair. The leadscrew 10 is mounted on a bracket 11 secured on the stop 5, and the nut 9 is installed in the wedge 8. The wedge 8 is provided with a recess 12 to accommodate the nut 9 and a through hole 13 to pass the leadscrew 10. The leadscrew 10 is rotated by a handwheel 14 coupled therewith.

In an alternative embodiment of the wedge drive, use may be made of any known drive suitable for this purpose.

In order to enlarge the area of contact between the surfaces of each wedge 8 and the stop 4, secured on the latter by way of pivots 15 are parts 16 provided with flat surfaces facing the wedges 8. The contacting surfaces of the part 16 and the stops 4 are made cylindrical. The contact of each part 16 with the surface of the wedge 8 is accomplished through a plate 17 removably coupled with the part 16 for replacement when worn down.

The fact that the part 16 is pivotally secured on the stop 4 provides for a self-alignment of this part and mating of the entire surface thereof with the wedge in any position of the crane slewing portion 2 relative to the stationary portion. This ensures a larger area of contact and uniform distribution of the load over the entire area.

Figure 3:
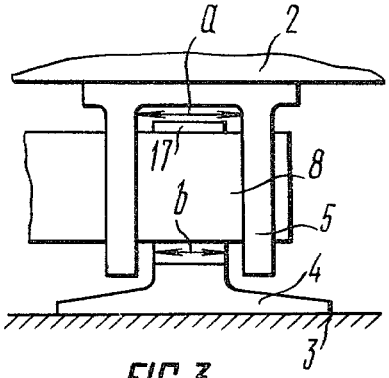
FIG. 3 is a view taken along the arrow A of FIG. 2.

The stops 5 secured on the crane slewing portion 2 are U-shaped, as is shown on FIG. 3. A distance "a" between cheeks of the stop 5 is generally somewhat greater than a width "b" of the stop 4 to pass the latter between the cheeks when the crane slewing portion is rotated. The embodiment of the stops 5 in a U-shaped form makes it possible to provide the most suitable system for the transfer of loads (a beam resting on two supports).

Alternatively, the stops to be installed on the crane stationary portion may be made U-shaped, whereas the stops to be installed on the slewing portion may be made solid.

The device for locking the slewing portion of a cargo crane relative to the stationary portion thereof operates in the following way.

The crane slewing portion 2 is set in a secured for sea position and locked against turning. To this end, the lead-screws 10 should be rotated to impart a translatory motion to the nuts 9. While moving along the lead-screws 10, the nuts 9 bear against the wedge 8 and shift the latter upward (according to the drawing) along guides 18 (FIG. 2) secured on the bracket 11. Thus the wedges 8 are pushed into a clearance between the stops 4 and 5 until their mating surfaces are brought in a tight contact. When swaying in either direction, the crane slewing portion 2 acts through the stops 5 on the wedges 8 which are pressed to the parts 16 pivotally secured on the stops 4 and transfer the loads to the crane stationary portion 3. Thus the crane slewing portion is prevented from turning in either direction relative to the stationary portion. If at the moment of locking, the crane slewing portion 2 is set with a deviation from its nominal position, i.e. with different clearances formed between the stops 5 and 4 on both sides, the travel of the wedges will be different, however the resulting skewness between the wedges 8 and stops 4 is obviated by pivoting of the part 16. Thus, a larger area of contact between the wedges 8 and the stop 4 is provided, which ensures a high operational reliability of the device. To prevent breakage of the crane slewing mechanism (not shown), there is provided an interlocking accomplished with the help of limit switches 19 (FIG. 2) which exclude any possibility of switching on the slewing mechanism when the crane is in the locked condition.

Figure 4:
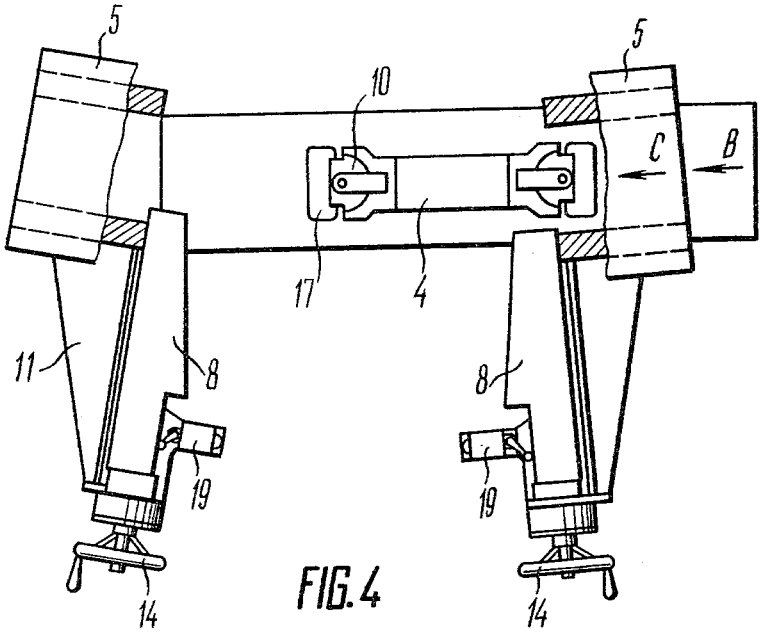
FIG. 4 is a partially cut-away top view, illustrating a locking device, according to the invention, with wedges withdrawn for rotation of a crane slewing portion.
Figure 5:
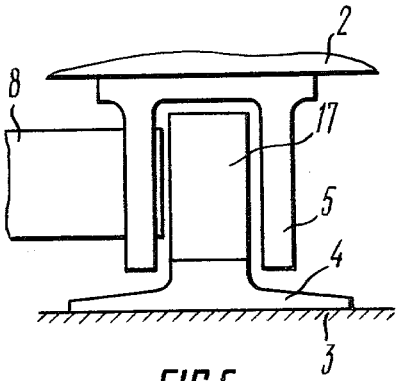
FIG. 5 is a view taken along the arrow B of FIG. 4.

To put the crane into operation for cargo handling, the slewing portion thereof should be unlocked. To this end, the handwheels 14 together with leadscrews 10 should be rotated in reverse to move the nuts 9 together with the wedges 8 downward (according to the drawing) along the leadscrews 10, thereby bringing the wedges 8 out of the clearances between the stops 4 and 5. The U-shaped form of the stops 5 allows the stop 4 to freely pass between the cheeks of the stops 5 when the crane is being slewed. Mutual arrangement of the stops 4, 5 and the wedges 8 after the latter have been brought out of contact with these stops is shown in FIGS. 4 and 5.

An experimental embodiment of the locking device made according to the present invention has been installed on a sea-going floating crane, tested under conditions of sea passages and has proved to be able to ensure a reliable locking of the crane slewing portion.

What is claimed is:

1. In a cargo crane having a slewing portion movable with respect to a stationary portion, a device for locking the slewing portion relative to the stationary portion comprising:

first stop means rigidly secured on the slewing portion of the crane;

second stop means rigidly secured on the stationary portion of the crane, said first and said second stop means having confronting surfaces spaced from each other when said slewing portion is in a position to be locked;

wedge means movable into a space between the confronting surfaces for frictionally engaging each of the confronting surfaces to thereby lock said first stop means relative to said second stop means; and drive means for bringing said wedge means into and out of frictional engagement with said confronting surfaces.

2. A device according to claim 1, wherein one of said first and said second stop means comprises a plate and means for pivotally securing said plate on its associated portion of the crane, said plate having a flat surface forming the confronting surface of said one stop means.

3. A device according to claim 1, wherein said wedge means has an angle of inclination not greater than 6°.

4. A device according to claim 1, wherein said drive means comprises a nut non-rotatably carried by said wedge means and a leadscrew carried by said first stop means, said leadscrew threadedly engaging said nut so that rotation of said leadscrew translates said wedge means.

5. A device according to claim 1, wherein said first stop means comprises a U-shaped member, and wherein said second stop means is positioned inside said U-shaped member upon rotation of the slewing portion of the crane.

6. A device according to claim 5, wherein said second stop means comprises a holding member secured on the stationary portion of the crane having end portions with cylindrical recesses formed therein; parts positioned in the cylindrical recesses of the end portions of the holding member, each part having a cylindrical surface positioned in and engaging a wall of the end portion forming the recess and a second surface; means for pivotally connecting said parts to said holding member; and plates carried by said second surfaces, said plates having flat surfaces forming surfaces confronting surfaces of said U-shaped member; said wedge means comprising a pair of wedges movable into spaces between the U-shaped member and the plates.

7. A device according to claim 1, wherein the slewing portion is rotatable with respect to the stationary portion.

* * * * *